US008449077B2

(12) United States Patent
Nishikawa

(10) Patent No.: US 8,449,077 B2
(45) Date of Patent: May 28, 2013

(54) DROPLET EJECTION HEAD

(75) Inventor: Baku Nishikawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 177 days.

(21) Appl. No.: 13/169,848

(22) Filed: Jun. 27, 2011

(65) Prior Publication Data

US 2011/0316934 A1 Dec. 29, 2011

(30) Foreign Application Priority Data

Jun. 28, 2010 (JP) ..... 2010-146657

(51) Int. Cl.
*B41J 2/04* (2006.01)

(52) U.S. Cl.
USPC ..... 347/54; 347/68; 347/65; 347/94

(58) Field of Classification Search
USPC ..... 347/54, 68, 70, 71, 65, 94
See application file for complete search history.

(56) References Cited

U.S. PATENT DOCUMENTS 6,412,926 B1 * 7/2002 Okuda ..... 347/70

FOREIGN PATENT DOCUMENTS

| | | | |
|---|---|---|---|
| JP | 1-166963 | A | 6/1989 |
| JP | 2002-321361 | A | 11/2002 |
| JP | 2009-56766 | A | 3/2009 |

* cited by examiner

*Primary Examiner* — Juanita D Jackson
(74) *Attorney, Agent, or Firm* — Birch, Stewart, Kolasch & Birch, LLP

(57) ABSTRACT

In a droplet ejection head, each of droplet ejection units includes: a nozzle which ejects droplets of liquid, a pressure chamber which is filled with the liquid and connected to the nozzle, a drive element which applies pressure to the liquid inside the pressure chamber, and an individual supply channel and an individual recovery channel which are connected to the pressure chamber. The liquid is supplied to and recovered from the pressure chamber through the individual supply channel and the individual recovery channel. In each of the droplet ejection units, a diameter Dn (μm) of the nozzle, a flow channel resistance R1 ($Ns/m^5$) of the individual supply channel and a flow channel resistance R2 ($Ns/m^5$) of the individual recovery channel satisfy:

$$3.247\times10^{15}\exp(-0.1717\,Dn)\leqq R1\leqq 3.278\times10^{15}\exp(-0.1456\,Dn);$$

and $$3.247\times10^{15}\exp(-0.1717\,Dn)\leqq R2\leqq 3.278\times10^{15}\exp(-0.1456\,Dn).$$

10 Claims, 10 Drawing Sheets

HIGHEST MENISCUS POSITION OF 2μm AT ONE NOZZLE
(DISPLACEMENT VOLUME MODEL)

REFILL COMPLETION TIME OF 30μs AT ONE NOZZLE
(DISPLACEMENT VOLUME MODEL)

DROPLET EJECTION HEAD

BACKGROUND OF THE INVENTION

1. Field of the Invention

The present invention relates to a droplet ejection head, and more particularly to technology for improving fluid cross-talk and refilling characteristics of the droplet ejection head.

2. Description of the Related Art

A recording apparatus based on an inkjet method has an inkjet head in which a plurality of nozzles are arranged, and forms an image on a recording medium by ejecting and depositing inks onto the recording medium respectively from the nozzles of the inkjet head. Inkjet recording apparatuses are used widely, due to their excellent quietness, low running costs, and their capacity to record images of high quality onto recording media of various types.

An inkjet head using pressure generating elements is known. The inkjet head has a common flow channel in which ink is stored, individual supply channels connected to the common flow channel, pressure chambers connected to the respective individual supply channels, pressure generating elements which respectively cause deformation of the pressure chambers, and nozzles connected to the respective pressure chambers. In the inkjet head, the ink is supplied to the pressure chambers from the common flow channel in which the ink is stored, the pressure generating elements are driven to apply pressure to the ink inside the pressure chambers, and the ink is thereby ejected from the nozzles connected to the pressure chambers.

In an inkjet head of this kind, a phenomenon known as fluid cross-talk is liable to occur in which pressure variation in a pressure chamber affects adjacent nozzles (and especially, the meniscuses therein) through the flow channels. In order to resolve this problem, a structure is widely used in which dampers are arranged inside the flow channels, thereby impeding transmission of pressure variation to adjacent nozzles. However, in recent years, it has become difficult to arrange dampers due to the demand for higher density of the ejection elements in the inkjet head. Furthermore, when the flow channels are restricted in order to suppress the transmission of pressure variation, it is important to achieve a balance between the effects of fluid cross-talk and individual refilling characteristics.

Japanese Patent Application Publication No. 2002-321361 discloses a circulation type head having an ink reservoir on either end side of a partition defining a flow channel, wherein a total of the surface areas of opening sections of ink supply apertures and a total of the surface areas of opening sections of ink recovery apertures have prescribed relationships with a total of the surface areas of the cross sections of the flow channels taken in planes perpendicular to their lengthwise directions. By means of this composition, it is possible to prevent aggregation of ink.

However, it is not possible to control fluid cross-talk and individual refilling by simply setting a prescribed relationship between the surface area of the opening sections and the cross-sectional area of the flow channels. Fluid cross-talk and individual refilling effects are governed significantly by the flow channel resistance, and in considering the flow channel resistance, it is necessary to take account not only of the cross-sectional area of the flow channels, but also the length of the flow channels and the viscosity of the liquid.

Japanese Patent Application Publication No. 01-166963 discloses an inkjet print head having a first ink channel through which ink is supplied and a second ink channel through which air bubbles are expelled, wherein the flow channel resistance of the second ink channel is set to a range of one to two times the flow channel resistance of the first ink channel. By means of this composition, the air bubble expulsion mechanism of the inkjet print head is improved.

However, the second ink channel is not connected to a circulation channel but to a dummy nozzle provided in order to expel air bubbles, and although the second ink channel has an effect in suppressing cross-talk, the flow channel resistance ratio is designed with air bubble expulsion characteristics in mind, and fluid cross-talk and individual refilling are not taken into account.

Japanese Patent Application Publication No. 2009-056766 discloses a droplet ejection apparatus in which two or more circulation channels are arranged symmetrically about the nozzle axis. By means of this composition, symmetry is also imparted to the ink flow generated inside the connection channels, and ejection defects are prevented.

When ejecting ink, ink flow is also generated in the supply channels, as well as the circulation channels. Hence, even if the circulation channels are symmetrically arranged, it is not possible to prevent ejection defects by imparting symmetry to the ink flow produced inside the connection channels.

SUMMARY OF THE INVENTION

The present invention has been contrived in view of these circumstances, an object thereof being to provide a droplet ejection head capable of simultaneously achieving improvement in both the fluid cross-talk and refilling characteristics.

In order to attain the aforementioned object, the present invention is directed to a droplet ejection head, comprising: a plurality of nozzles which eject droplets of liquid; a plurality of pressure chambers which are filled with the liquid and connected respectively to the nozzles; a plurality of drive elements which are arranged correspondingly to the pressure chambers, the drive elements applying pressure to the liquid inside the corresponding pressure chambers; a plurality of individual supply channels which are connected respectively to the pressure chambers, the liquid being supplied to the pressure chambers through the individual supply channels; a plurality of individual recovery channels which are connected respectively to the pressure chambers, the liquid being recovered from the pressure chambers through the individual recovery channels; a plurality of common supply channels which are connected to the individual supply channels and supply the liquid to the individual supply channels, respectively; and a plurality of common recovery channels which are connected to the individual recovery channels and recover the liquid from the individual recovery channels, respectively, wherein: the droplet ejection head has a plurality of droplet ejection units, each of the droplet ejection units including one of the nozzles, one of the pressure chambers which is connected to the one of the nozzles, one of the drive elements which is arranged correspondingly to the one of the pressure chambers, one of the individual supply channels which is connected to the one of the pressure chambers, and one of the individual recovery channels which is connected to the one of the pressure chambers; and in each of the droplet ejection units, a diameter Dn (μm) of the one of the nozzles, a flow channel resistance R1 ($Ns/m^5$) of the one of the individual supply channels and a flow channel resistance R2 ($Ns/m^5$) of the one of the individual recovery channels satisfy:

$$3.247\times10^{15}\exp(-0.1717\,Dn)\leqq R1\leqq 3.278\times 10^{15}\exp(-0.1456\,Dn);$$

and $$3.247\times10^{15}\exp(-0.1717\,Dn)\leqq R2\leqq 3.278\times 10^{15}\exp(-0.1456\,Dn).$$

The present inventor carried out thorough research into the improvement of fluid-cross-talk and refilling characteristics, in a droplet ejection head having circulation channels. As a result of this, the inventor arrived at the present invention by finding that fluid cross-talk and refilling characteristics can be improved by setting a prescribed relationship between the flow channel resistance of the individual supply channel and the individual recovery channel, and the nozzle diameter.

According to this aspect of the present invention, it is possible to suppress fluid cross-talk, and refilling can be completed stably and without delay. Consequently, it is possible to eject droplets of liquid at a high frequency.

Preferably, the common supply channels are arranged in parallel, and are joined together at ends to constitute a supply manifold; and the common recovery channels are arranged in parallel, and are joined together at ends to constitute a recovery manifold.

Preferably, the supply manifold and the recovery manifold are connected to each other through only the droplet ejection units.

Preferably, in each of the droplet ejection units, the flow channel resistance R1 of the one of the individual supply channels is substantially equal to the flow channel resistance R2 of the one of the individual recovery channels.

According to this aspect of the present invention, the ink flow generated by fluid cross-talk can be distributed over all of the nozzles. It is possible to prevent the effects of cross-talk from being concentrated in the nozzles of a certain particular region since there is no bias in the ink flow. It is then possible to suppress cross-talk by averaging the effects of cross-talk over all of the nozzles.

Preferably, in each of the droplet ejection units, a cross-sectional area and a length of the one of the individual supply channels are substantially equal respectively to a cross-sectional area and a length of the one of the individual recovery channels.

According to this aspect of the present invention, it is possible to distribute the ink flow generated by fluid cross-talk more effectively over all of the nozzles.

Preferably, in each of the droplet ejection units, an arrangement of the one of the pressure chambers, the one of the individual supply channels and the one of the individual recovery channels is mirror symmetrical or rotationally symmetrical about a central axis of the one of the nozzles.

According to this aspect of the present invention, it is possible to prevent deviation of the ejection of the droplets.

Preferably, in each of the droplet ejection units, the diameter Dn (μm) of the one of the nozzles, a flow channel inertance M1 ($kg/m^4$) of the one of the individual supply channels and a flow channel inertance M2 ($kg/m^4$) of the one of the individual recovery channels satisfy:

$$2.075\times10^{9}\exp(-8.369\times10^{-2}\,Dn)\leqq M1\leqq 1.838\times 10^{9}\exp(-6.475\times10^{-2}\,Dn);$$

and $$2.075\times10^{9}\exp(-8.369\times10^{-2}\,Dn)\leqq M2\leqq 1.838\times 10^{9}\exp(-6.475\times10^{-2}\,Dn).$$

According to this aspect of the present invention, it is possible to optimize the refilling speed.

Preferably, in each of the droplet ejection units, the flow channel inertance M1 of the one of the individual supply channels is substantially equal to the flow channel inertance M2 of the one of the individual recovery channels.

According to this aspect of the present invention, it is possible to adjust the refilling speed. By varying the inertance, the timing of cross-talk can be staggered. Furthermore, since the timing is also varied similarly in relation to individual refilling, then it is possible to adjust refilling in accordance with the ejection frequency.

Preferably, each of the droplet ejection units includes a connecting channel which connects the one of the pressure chambers with the one of the nozzles.

According to the droplet ejection head of the present invention, it is possible to improve fluid cross-talk and refilling characteristics.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
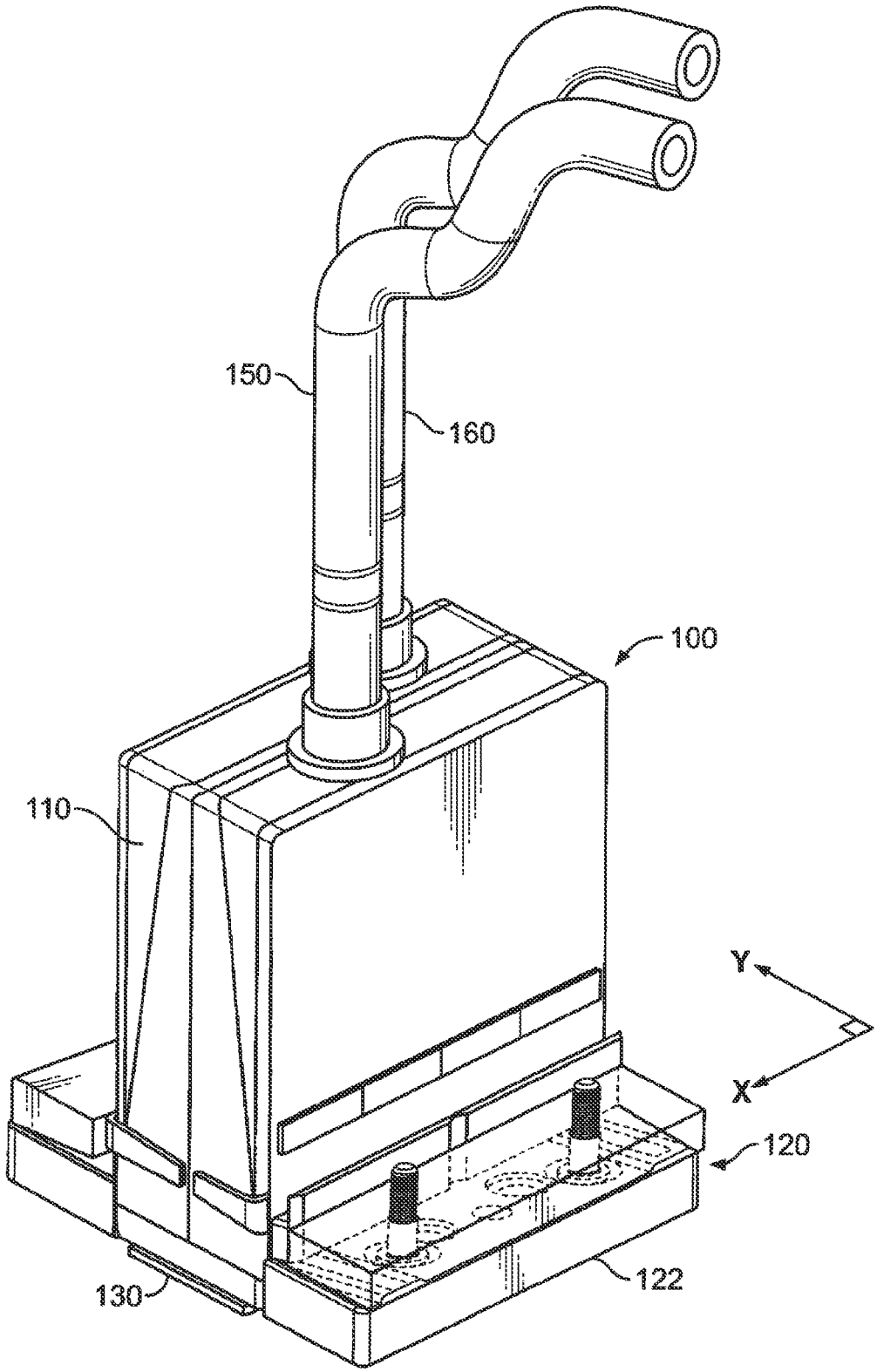
FIG. 1 is a perspective diagram of a droplet ejection head according to an embodiment of the present invention.

FIG. 1 is a perspective diagram of a droplet ejection head. The droplet ejection head 100 includes a mounting section 120 having a casing 110 and a mounting component 122, and a substrate 130, which is attached to the bottom of the casing 110. The substrate 130 is made of silicon, such as monocrystalline silicon. Finely processed fluid channels are formed internally in the substrate 130. An end of a supply tube 150 and an end of a recovery tube 160 are connected to the droplet ejection head 100, and the other ends of the supply tube 150 and the recovery tube 160 are connected to liquid tanks (not shown).

Figure 2:
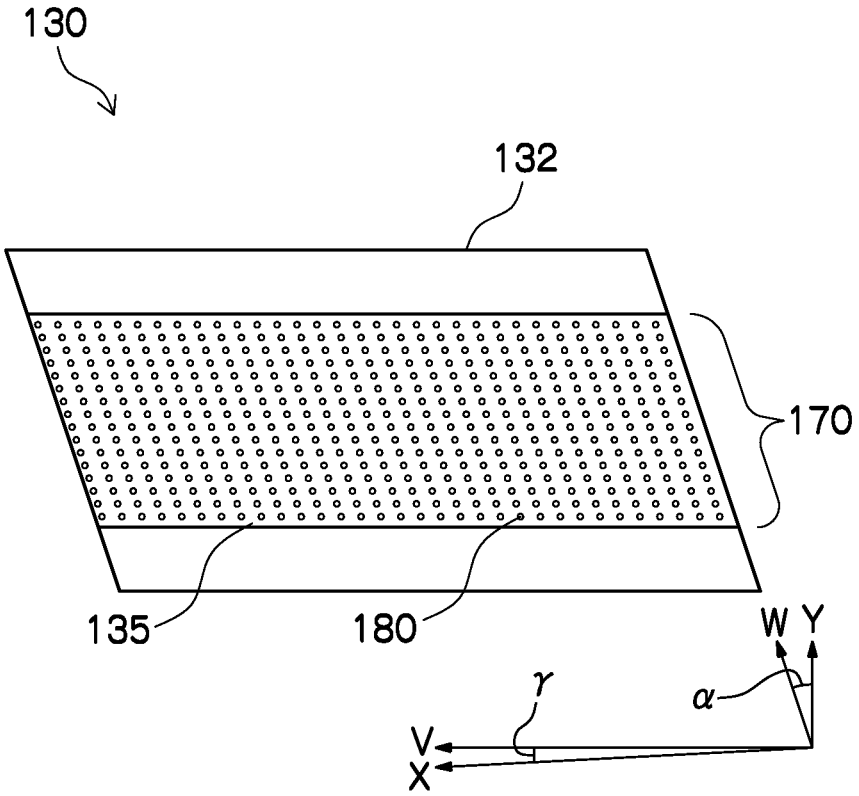
FIG. 2 is a diagram showing a bottom surface (nozzle arrangement) of a substrate.

FIG. 2 shows the bottom surface of the substrate 130. A nozzle layer 132 is arranged on the substrate 130. The nozzle layer 132 has a nozzle face 135. The nozzle face 135 has a plurality of nozzle rows 170, each constituted of a plurality of nozzles 180. The nozzle face 135 has long end faces and short end faces, and is substantially quadrilateral in shape. The long end faces extend in a direction V, which forms an angle $\gamma$ with respect to the X direction, and the short end faces extend in a direction W, which forms an angle $\alpha$ with respect to the Y direction. The W direction can be set to another oblique angle relative to the widthwise direction of the substrate 130. The nozzle face 135 can be formed as a surface of a separate nozzle layer 132. Alternatively, the nozzle face 135 and the nozzle layer 132 can be formed as a unitary part of the substrate 130.

Figure 3A:
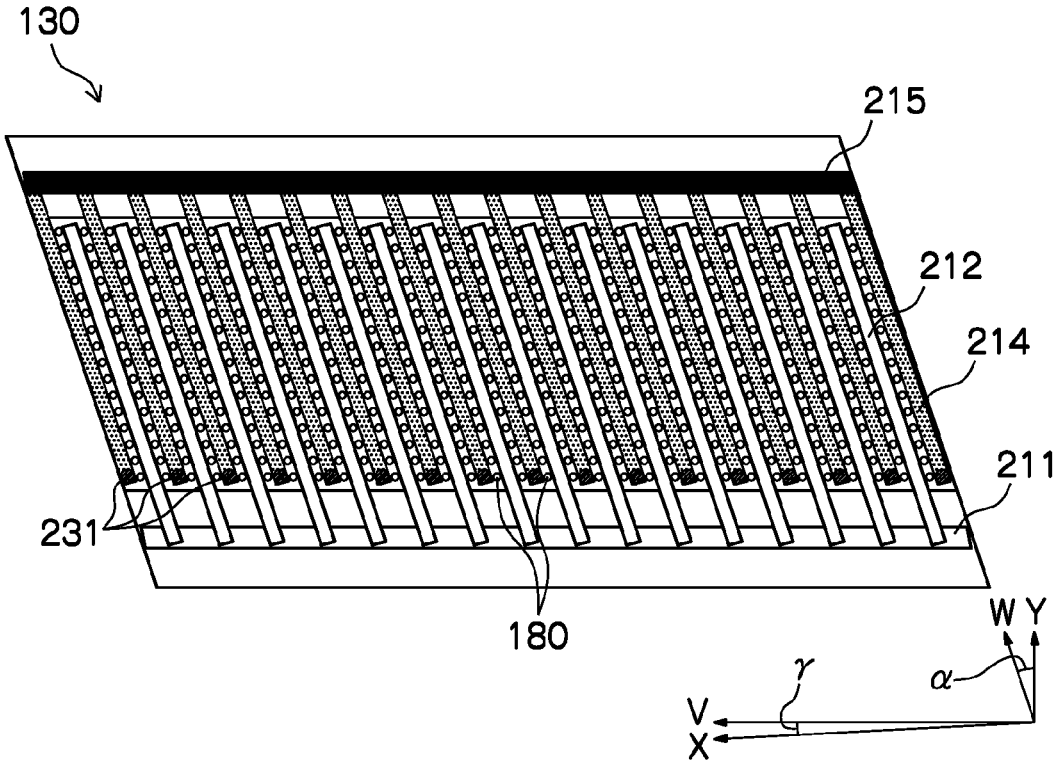
FIG. 3A is a plan view perspective diagram showing a flow of liquid inside the substrate.
Figure 3B:
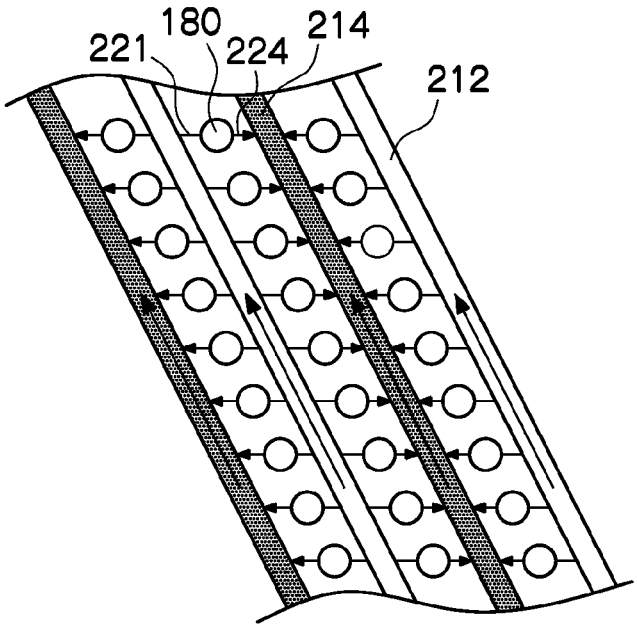
FIG. 3B is a partial enlarged view of same.

FIG. 3A is a plan view perspective diagram showing the flow of liquid in the substrate 130, and FIG. 3B is a partial enlarged view of same. As shown in FIGS. 3A and 3B, a first main flow channel 211 is formed in the substrate 130. The first main flow channel 211 is connected to the supply tube 150. A plurality of common supply channels 212 are formed in a direction intersecting to the first main flow channel 211. The first main flow channel 211 and the common supply channels 212 constitute a liquid supply manifold. A plurality of droplet ejection units including the nozzles 180 which eject droplets are arranged along the common supply channels 212. A plurality of common recovery channels 214 which recover the liquid are arranged opposingly to the common supply channels 212 across the droplet ejection units. A second main flow channel 215 is formed in a direction intersecting to the common recovery channels 214. The second main flow channel 215 is connected to the recovery tube 160. The common recovery channels 214 and the second main flow channel 215 constitute a liquid recovery manifold.

A liquid circulation path is constituted of the supply tube 150 connected to the liquid tank, the supply manifold connected to the supply tube 150, the droplet ejection units connected to the supply manifold, the recovery manifold connected to the droplet ejection units, the recovery tube 160 connected to the recovery manifold, and the liquid tank connected to the recovery tube 160.

As shown in FIG. 3B, the common supply channels 212 and the common recovery channels 214 are arranged alternately. The droplet ejection units including the nozzles 180 are arranged along the common supply channels 212 and the common recovery channels 214, between the common supply channels 212 and the common recovery channels 214. The nozzles 180 are connected to pressure chambers 222 (see FIG. 4). Each of the pressure chambers 222 is connected to the common supply channel 212 through an individual supply channel 221, and is also connected to the common recovery channel 214 through an individual recovery channel 224.

Figure 4:
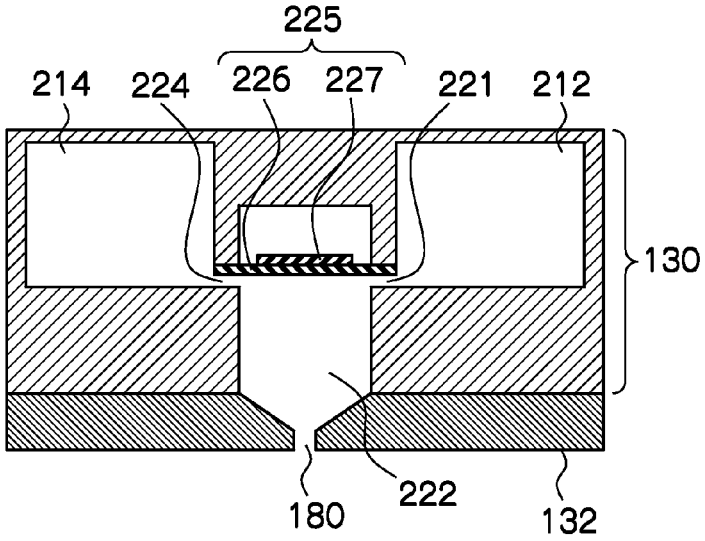
FIG. 4 is a principal cross-sectional diagram of the substrate according to an embodiment of the present invention.

FIG. 4 is a principal cross-sectional diagram of the substrate 130 shown in FIGS. 3A and 3B, according to an embodiment of the present invention. The common supply channel 212 and the common recovery channel 214 are formed in the substrate 130. The individual supply channel 221, the pressure chamber 222 and the individual recovery channel 224 are arranged inside the substrate 130. The substrate 130 has the nozzle layer 132. The nozzle 180 is formed in the nozzle layer 132 at the position corresponding to the pressure chamber 222. An actuator 225 which applies pressure to the liquid inside the pressure chamber 222 is arranged at the position adjacent to the pressure chamber 222. The actuator 225 includes a plate-shaped diaphragm 226 and a drive element 227. The drive element 227 can be a piezoelectric element, for example. The common supply channel 212 and the pressure chamber 222 are connected through the individual supply channel 221. The common recovery channel 214 and the pressure chamber 222 are connected through the individual recovery channel 224. In FIG. 4, the droplet ejection unit includes: the nozzle 180, which ejects droplets; the pressure chamber 222, which is connected to the nozzle 180; the drive element 227, which applies pressure to the liquid inside the pressure chamber 222; the individual supply channel 221, which is connected to the pressure chamber 222 and supplies the liquid to the pressure chamber 222; and the individual recovery channel 224, which is connected to the pressure chamber 222 and recovers the liquid from the pressure chamber 222. The composition including the substrate 130 and the nozzle layer 132 is shown in FIG. 4; however, the composition is not limited to this. For example, it is also possible to compose the substrate 130 of a plurality of layers. Alternatively, the substrate 130 and the nozzle layer 132 can be unitedly composed.

Figure 5:
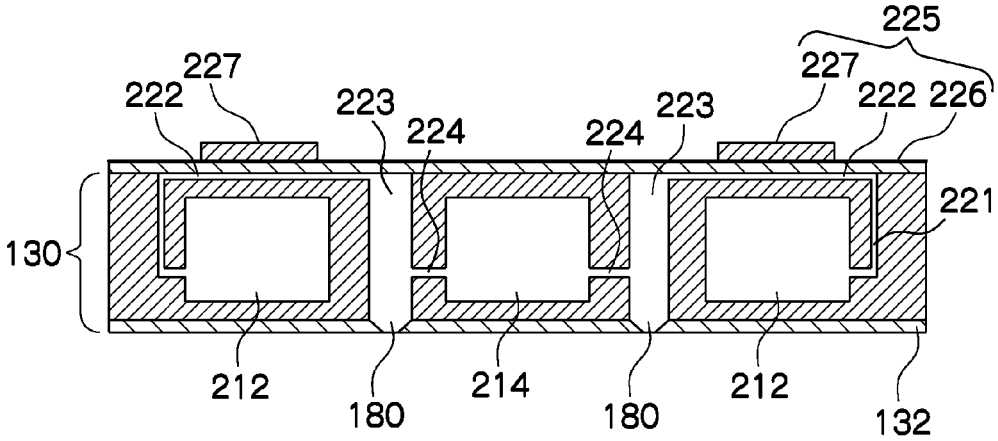
FIG. 5 is a principal cross-sectional diagram of the substrate according to another embodiment of the present invention.

FIG. 5 is a principal cross-sectional diagram of the substrate 130 shown in FIGS. 3A and 3B, according to another embodiment of the present invention. The common supply channels 212 and the common recovery channels 214 are formed in the substrate 130. The individual supply channels 221, the pressure chambers 222 and the individual recovery channels 224 are arranged inside the substrate 130. The substrate 130 has the nozzle layer 132. The actuators 225 which apply pressure to the liquid inside the pressure chambers 222 are arranged at the positions adjacent to the pressure chambers 222. The actuators 225 each include the plate-shaped diaphragm 226 and the drive elements 227. The drive elements 227 can be piezoelectric elements, for example. The common supply channels 212 and the pressure chambers 222 are connected through the individual supply channels 221. The common recovery channels 214 and the pressure chambers 222 are connected through the individual recovery channels 224. The pressure chambers 222 are connected to connection channels 223. The nozzles 180 are formed in the nozzle layer 132 at the positions corresponding to the connection channels 223. In other words, the nozzles 180 and the pressure chambers 222 are connected through the connection channels 223. In FIG. 5, the droplet ejection unit includes: the nozzle 180, which ejects droplets; the connection channel 223, which is connected to the nozzle 180; the pressure chamber 222, which is connected to the connection channel 223; the drive element 227, which applies pressure to the liquid inside the pressure chamber 222; the individual supply channel 221, which is connected to the pressure chamber 222 and supplies the liquid to the pressure chamber 222; and the individual recovery channel 224, which is connected to the pressure chamber 222 and recovers the liquid from the pressure chamber 222.

As shown in FIGS. 4 and 5, the droplet ejection units are connected indirectly to each other through the common supply channels 212 and the common recovery channels 214. The liquid circulation path is constituted of the droplet ejection units, the common supply channels 212, the common recovery channels 214, the supply tube 150, the recovery tube 160, and the liquid tank. Consequently, a phenomenon known as fluid cross-talk is liable to occur in which the pressure variation in one of the droplet ejection units affects the nozzles (in particular, the meniscuses therein) of other adjacent droplet ejection units through the common supply channels and the common recovery channels.

The present inventor has found that in a droplet ejection head having a circulation channel, fluid cross-talk and refilling characteristics can be improved by setting a prescribed relationship between the flow channel resistance of the individual supply channel and the individual recovery channel, and the nozzle diameter.

In an inkjet head having a circulation channel, fluid cross-talk is suppressed by setting the flow channel resistance R1 of the individual supply channel 221 and the flow channel resistance R2 of the individual recovery channel 224 to a prescribed range. This is for the following reasons. Fluid cross-talk is transmitted through the individual supply channels 221 and the individual recovery channels 224. Therefore, by setting both of the flow channel resistances R1 and R2 to a prescribed range, then the flow of the ink produced by the fluid cross-talk can be distributed over all of the nozzles in the inkjet head.

On the other hand, even if the flow channel resistances of the individual supply channel and the individual recovery channel are set to the prescribed range in order to suppress fluid cross-talk, the refilling characteristics are not necessarily improved. The refilling characteristics per nozzle are governed by the following three factors of the droplet ejection unit: the property of the individual supply channel, the property of the individual recovery channel, and the nozzle diameter. The present inventor carried out equivalent circuit analysis of lumped parameter system, and found the appropriate relationship between the property of the individual supply channel, the property of the individual recovery channel, and the nozzle diameter. The equivalent circuit analysis of lumped parameter system was performed in such a manner that the following conditions were satisfied:

(1) the projecting meniscus height after droplet ejection was not more than 2 μm with respect to the meniscus in a steady state;

(2) the refill completion time was not longer than 30 μs; and (3) the same volume of droplet was ejected.

Figure 12:
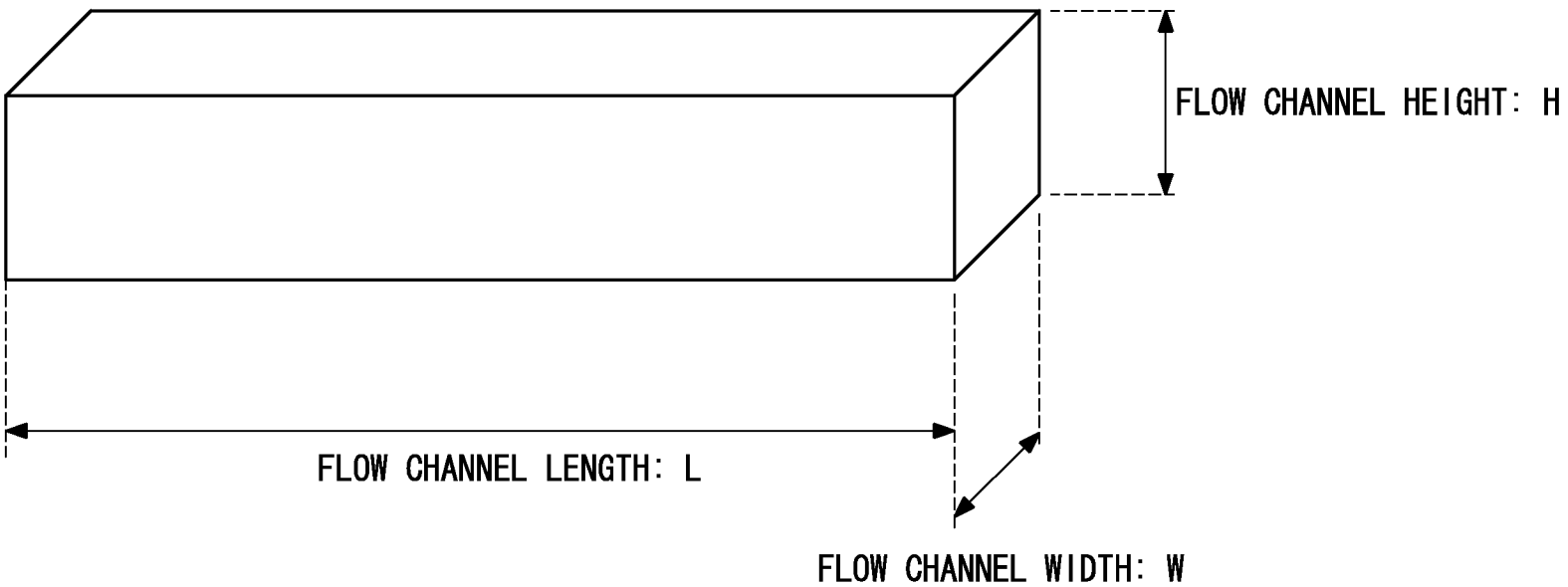
FIG. 12 is an enlarged diagram of an individual supply channel or individual recovery channel.

Based on these premises, values were determined for the nozzle diameter; and the flow channel resistance, the flow channel inertance, the flow channel width, the flow channel height, the flow channel length and the flow channel width of each of the individual supply channel and the individual recovery channel. FIG. 12 shows the flow channel width, height and length of the individual supply channel or the individual recovery channel. Table 1 shows the respective values which satisfy the condition (1), and Table 2 shows the respective values which satisfy the condition (2).

TABLE 1

| Nozzle diameter Dn (μm) | Flow channel resistance R (Ns/m$^{5)}$ | Flow channel inertance M (kg/m$^{4)}$ | Flow channel width W (μm) | Flow channel height H (μm) | Flow channel length L (μm) |
|---|---|---|---|---|---|
| 15.7 | 2.21E+14 | 5.56E+08 | 18.0 | 25.0 | 250 |
| 17.0 | 1.74E+14 | 5.00E+08 | 20.0 | 25.0 | 250 |
| 19.0 | 1.24E+14 | 4.26E+08 | 23.6 | 25.0 | 250 |
| 22.0 | 7.46E+13 | 3.28E+08 | 30.5 | 25.0 | 250 |

TABLE 2

| Nozzle diameter Dn (μm) | Flow channel resistance R (Ns/m$^{5)}$ | Flow channel inertance M (kg/m$^{4)}$ | Flow channel width W (μm) | Flow channel height H (μm) | Flow channel length L (μm) |
|---|---|---|---|---|---|
| 15.7 | 3.38E+14 | 6.67E+08 | 15.0 | 25.0 | 250 |
| 17.0 | 2.75E+14 | 6.12E+08 | 16.4 | 25.0 | 250 |
| 19.0 | 2.01E+14 | 5.33E+08 | 18.8 | 25.0 | 250 |
| 22.0 | 1.35E+14 | 4.44E+08 | 22.5 | 25.0 | 250 |

The inertance and the resistance are found for each of the individual supply channel and the individual recovery channel as follows.

When the cross-sectional area of a flow channel is uniform, the inertance m of the flow channel is represented as:

$$m = \frac{\rho l}{S},$$

where ρ is the density of the fluid, l is the length of the flow channel, and S is the cross-sectional area of the flow channel.

On the other hand, when the cross-sectional area of a flow channel is not uniform, the inertance m of the flow channel is represented as:

$$m = \int_0^l \frac{\rho}{S}\, dx.$$

According to the approximation model of E. L. Kyser, et. al. ("Design of Impulse Ink Jet", J. Appl. Photographic Engineering, 7(3), (1981) 73.), when the cross section of a flow channel is rectangular, the resistance r of the flow channel is represented as:

$$r = \frac{12\eta l}{S^2}\left\{0.33 + 1.02\left(z + \frac{1}{z}\right)\right\},$$

where η is the viscosity of the fluid, and z (z>1) is the aspect ratio of the cross section of the flow channel.

When the cross section of a flow channel is circular and the cross-sectional area of the flow channel is uniform, the resistance r of the flow channel is represented as:

$$r = \frac{128\eta l}{\pi d^4},$$

where d is the diameter of the flow channel.

When the cross section of a flow channel is circular and the cross-sectional area of the flow channel is not uniform, the resistance r of the flow channel is represented as:

$$r = \int_0^l \frac{128\eta}{\pi d^4}\, dx.$$

Figure 6:
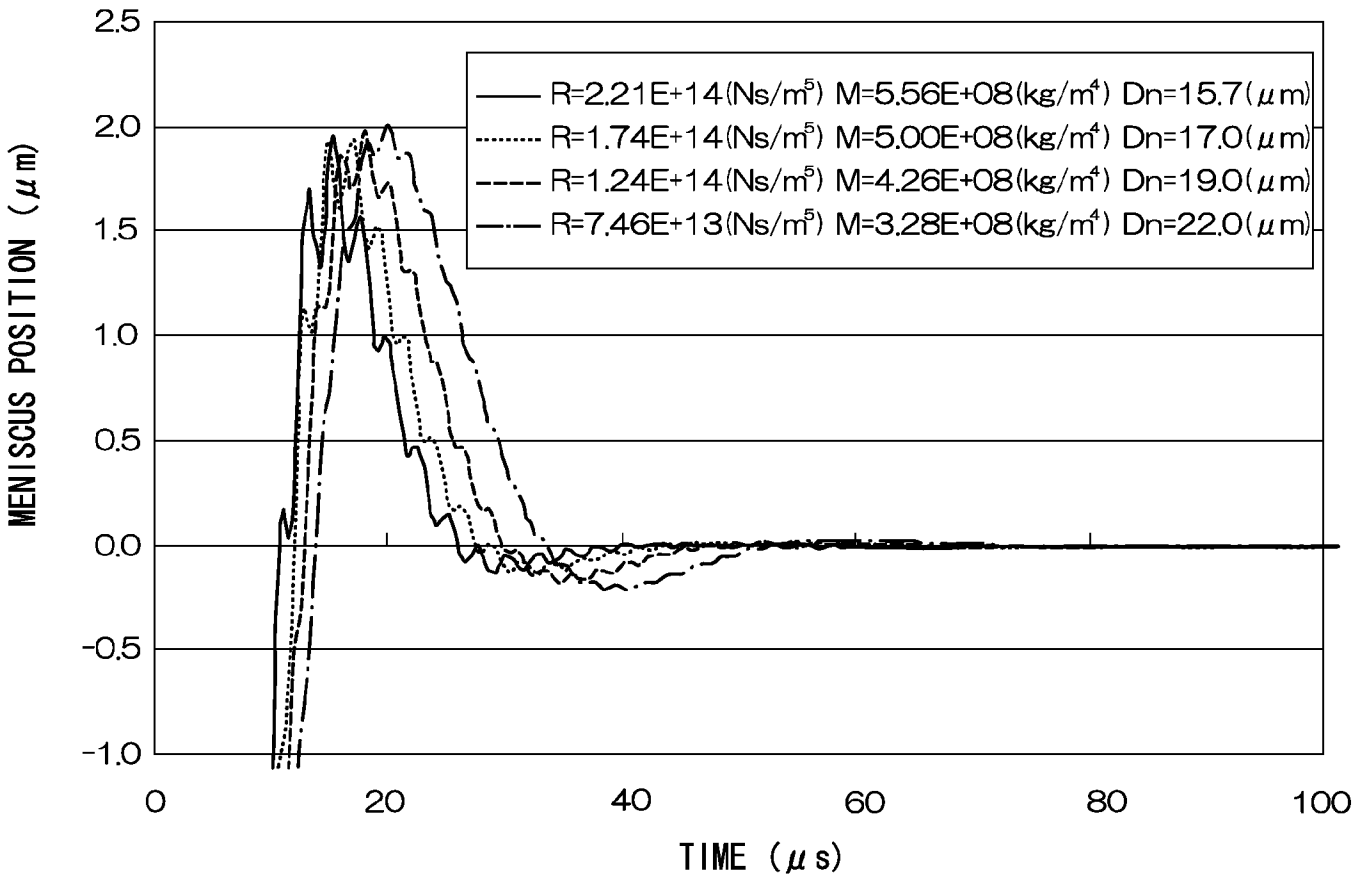
FIG. 6 is a graph showing the relationship between time after droplet ejection and displacement of the meniscus of the liquid.

FIG. 6 shows graphs representing the situation of refilling obtained by the equivalent circuit analysis of lumped parameter system, where while the nozzle diameter Dn is changed, the flow channel resistance R and the flow channel inertance M are adjusted in such a manner that the maximum projecting height of the meniscus becomes 2 μm. In FIG. 6, the horizontal axis indicates time and the vertical axis indicates an amount of displacement of the meniscus. The time zero is the time at which a droplet ejection is started. Thereupon, with the passage of time, the meniscus is displaced. If the values shown in Table 1 for the nozzle diameter Dn (μm), the flow channel resistance R ($Ns/m^5$), the flow channel inertance M ($kg/m^4$), the flow channel width W (μm), the flow channel height H (μm) and the flow channel length L (μm) are satisfied, then the maximum projecting height of the meniscus is not more than 2 μm, as shown in FIG. 6.

Figure 7:
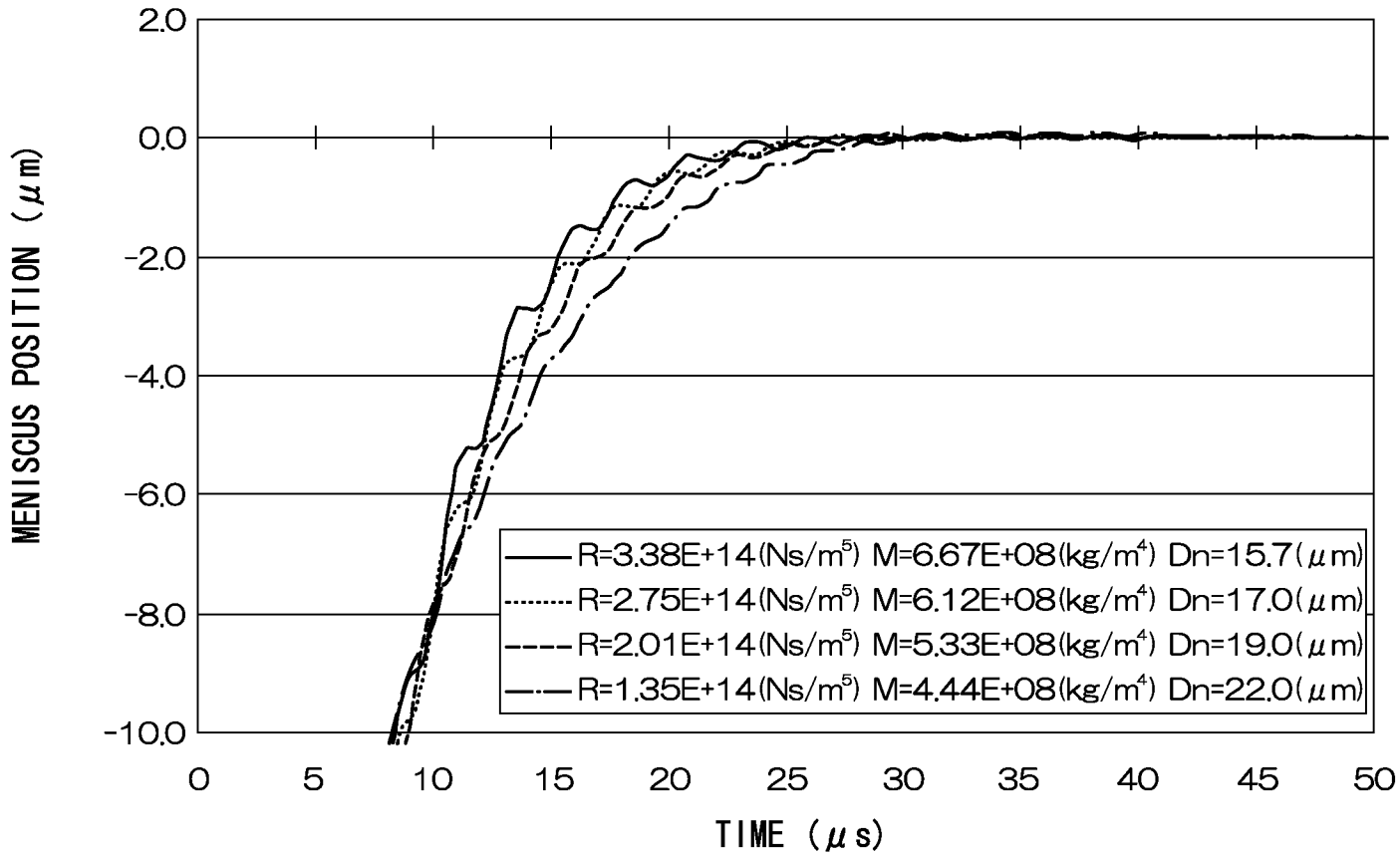
FIG. 7 is a graph showing the relationship between time after droplet ejection and displacement of the meniscus of the liquid.

FIG. 7 shows graphs representing the situation of refilling obtained by the equivalent circuit analysis of lumped parameter system, where while the nozzle diameter Dn is changed, the flow channel resistance R and the flow channel inertance M are adjusted in such a manner that the refill completion time (the time at which the meniscus position returned to 0) becomes 30 μs. In FIG. 7, the horizontal axis indicates time and the vertical axis indicates an amount of displacement of the meniscus. The time zero is the time at which a droplet ejection is started. Thereupon, with the passage of time, the meniscus is displaced. If the values shown in Table 2 for the nozzle diameter Dn (μm), the flow channel resistance R ($Ns/m^5$), the flow channel inertance M ($kg/m^4$), the flow channel width W (μm), the flow channel height H (μm) and the flow channel length L (μm) are satisfied, then the refilling time is not longer than 30 μs, as shown in FIG. 7.

Figure 8:
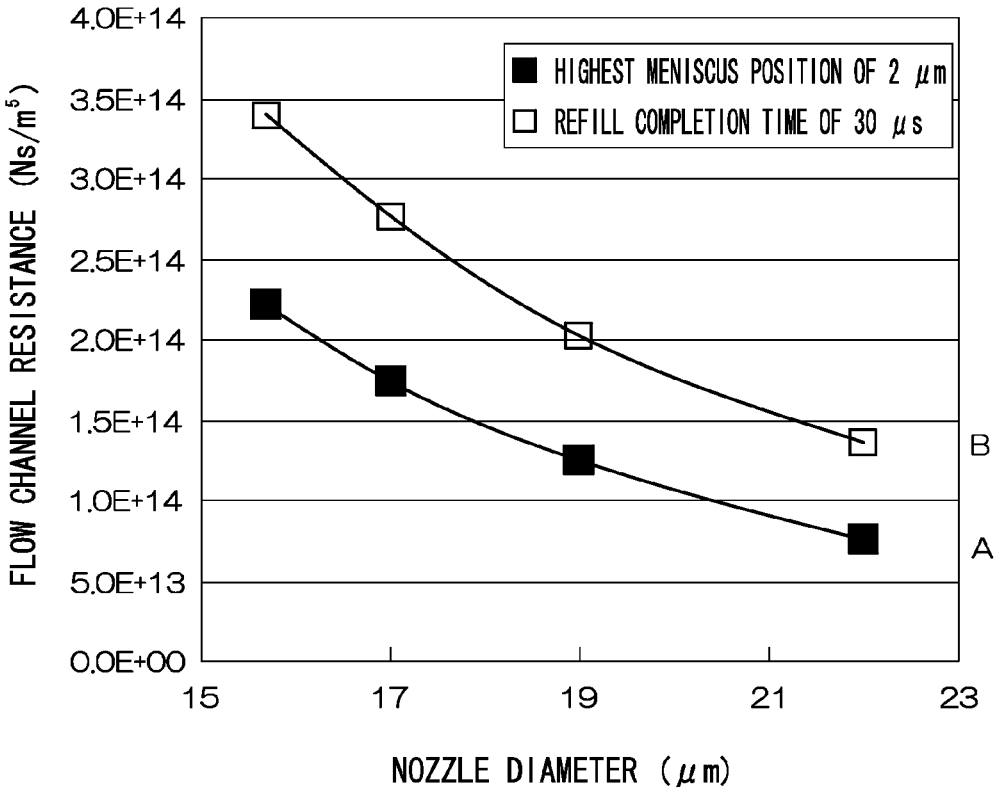
FIG. 8 is a graph showing the relationship between the nozzle diameter and the flow channel resistance.

FIG. 8 shows graphs in which the values for the nozzle diameter Dn (μm) and the flow channel resistance R ($Ns/m^5$) shown in Tables 1 and 2 are plotted, where the horizontal axis represents the nozzle diameter Dn and the vertical axis represents the flow channel resistance R. An exponential curve A was fitted to the points representing the values in Table 1, and an approximation formula for the curve A was calculated as:

$$R=3.247\times10^{15}\exp(-0.1717\,Dn).$$

Similarly, an exponential curve B was fitted to the points representing the values in Table 2, and an approximation formula for the curve B was calculated as:

$$R=3.278\times10^{15}\exp(-0.1456\,Dn).$$

Consequently, it is possible to suppress fluid cross-talk and to improve refilling characteristics by selecting values in the range between the curve A and the curve B for the flow channel resistance of the individual supply channel and individual recovery channel, and the nozzle diameter. More specifically, it is preferable that the flow channel resistance R1 ($Ns/m^5$) of the individual supply channel, the flow channel resistance R2 ($Ns/m^5$) of the individual recovery channel, and the nozzle diameter Dn (μm) satisfy:

$$3.247\times10^{15}\exp(-0.1717\,Dn)\leqq R1\leqq3.278\times10^{15}\exp(-0.1456\,Dn);$$

and $$3.247\times10^{15}\exp(-0.1717\,Dn)\leqq R2\leqq3.278\times10^{15}\exp(-0.1456\,Dn).$$

Figure 9:
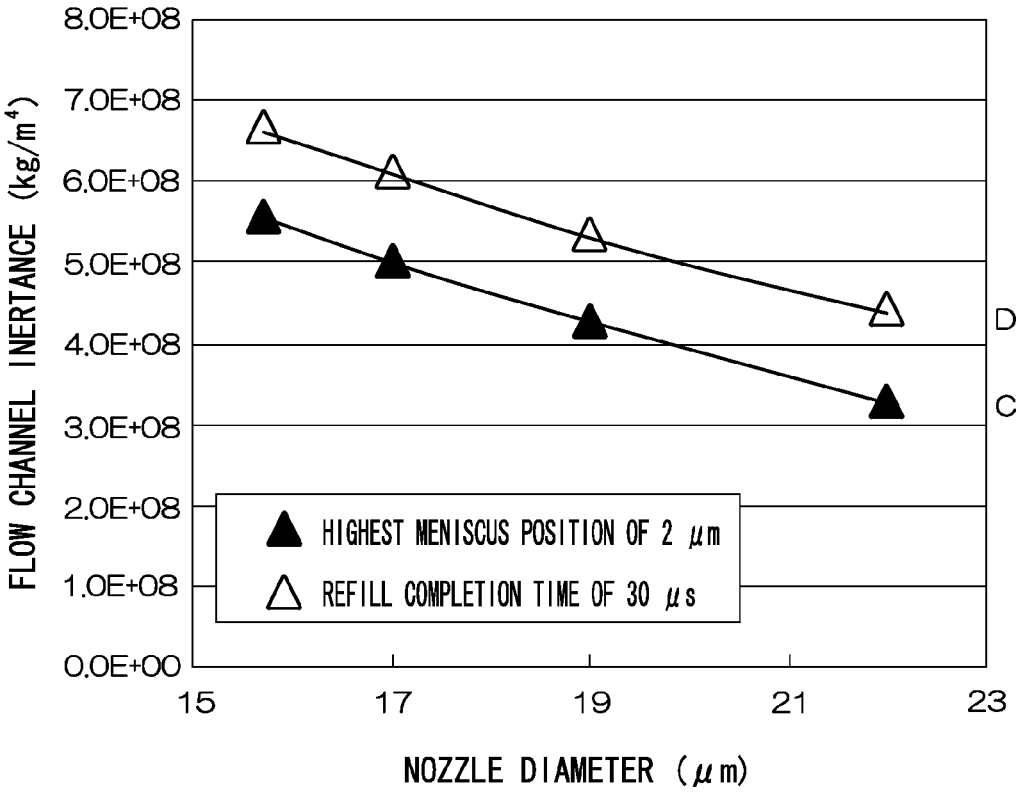
FIG. 9 is a graph showing the relationship between the nozzle diameter and the flow channel inertance.

FIG. 9 shows graphs in which the values for the nozzle diameter Dn (μm) and the flow channel inertance M ($kg/m^4$) shown in Tables 1 and 2 are plotted, where the horizontal axis represents the nozzle diameter Dn and the vertical axis represents the flow channel inertance M. An exponential curve C was fitted to the points representing the values in Table 1, and an approximation formula for the curve C was calculated as:

$$M=2.075\times10^{9}\exp(-8.369\times10^{-2}\,Dn).$$

Similarly, an exponential curve D was fitted to the points representing the values in Table 2, and an approximation formula for the curve D was calculated as:

$$M=1.838\times10^{9}\exp(-6.475\times10^{-2}\,Dn).$$

Consequently, it is possible to improve refilling characteristics by selecting values in the range between the curve C and the curve D for the flow channel inertance of the individual supply channel and the individual recovery channel, and the nozzle diameter. More specifically, it is preferable that the flow channel inertance M1 ($kg/m^4$) of the individual supply channel, the flow channel inertance M2 ($kg/m^4$) of the individual recovery channel, and the nozzle diameter Dn (μm) satisfy:

$$2.075\times10^{9}\exp(-8.369\times10^{-2}\,Dn)\leqq M1\leqq1.838\times10^{9}\exp(-6.475\times10^{-2}\,Dn);$$

and $$2.075\times10^{9}\exp(-8.369\times10^{-2}\,Dn)\leqq M2\leqq1.838\times10^{9}\exp(-6.475\times10^{-2}\,Dn).$$

Refilling characteristics are governed largely by the resistance of the flow channels. However, the inertance of the flow channels also has an influence, and desirably, the refilling characteristics can be improved by setting the inertance of the flow channels to a prescribed value.

Figure 10:
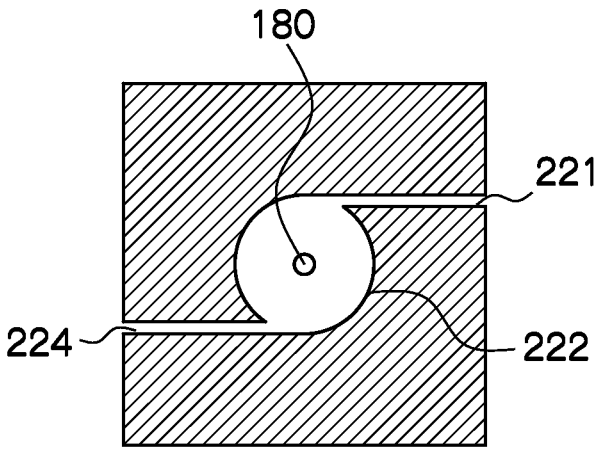
FIG. 10 is a principal cross-sectional diagram of the substrate according to an embodiment of the present invention.
Figure 11:
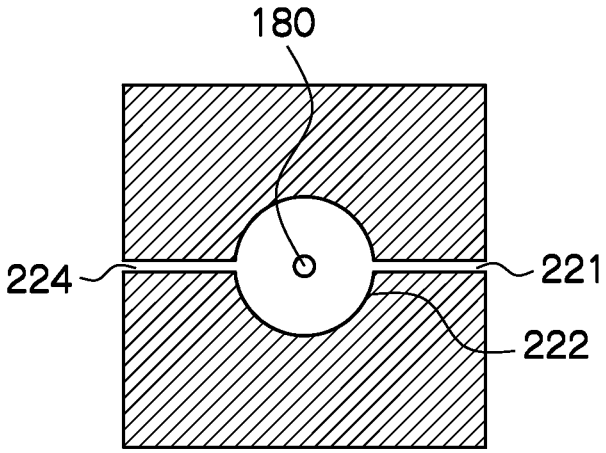
FIG. 11 is a principal cross-sectional diagram of the substrate according to another embodiment of the present invention.

In order to prevent deviation in the ejection of the droplets in the droplet ejection head shown in FIG. 4, it is desirable to maintain symmetry with respect to the central axis of the nozzle. FIGS. 10 and 11 show positional relationships of the nozzle 180, the pressure chamber 222, the individual supply channel 221 and the individual recovery channel 222 of droplet ejection units according to embodiments of the present invention. As shown in FIG. 10, the arrangement of the pressure chamber 222, the individual supply channel 221 and the individual recovery channel 224 can be rotationally symmetrical about the central axis of the nozzle 180. Alternatively, as shown in FIG. 11, the arrangement of the pressure chamber 222, the individual supply channel 221 and the individual recovery channel 224 can be mirror symmetrical about the central axis of the nozzle 180.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection head, comprising:

a plurality of nozzles which eject droplets of liquid;

a plurality of pressure chambers which are filled with the liquid and connected respectively to the nozzles;

a plurality of drive elements which are arranged correspondingly to the pressure chambers, the drive elements applying pressure to the liquid inside the corresponding pressure chambers;

a plurality of individual supply channels which are connected respectively to the pressure chambers, the liquid being supplied to the pressure chambers through the individual supply channels;

a plurality of individual recovery channels which are connected respectively to the pressure chambers, the liquid being recovered from the pressure chambers through the individual recovery channels;

a plurality of common supply channels which are connected to the individual supply channels and supply the liquid to the individual supply channels, respectively; and a plurality of common recovery channels which are connected to the individual recovery channels and recover the liquid from the individual recovery channels, respectively, wherein:

the droplet ejection head has a plurality of droplet ejection units, each of the droplet ejection units including one of the nozzles, one of the pressure chambers which is connected to the one of the nozzles, one of the drive elements which is arranged correspondingly to the one of the pressure chambers, one of the individual supply channels which is connected to the one of the pressure chambers, and one of the individual recovery channels which is connected to the one of the pressure chambers; and in each of the droplet ejection units, a diameter Dn (μm) of the one of the nozzles, a flow channel resistance R1 ($Ns/m^5$) of the one of the individual supply channels and a flow channel resistance R2 ($Ns/m^5$) of the one of the individual recovery channels satisfy:

$$3.247\times10^{15}\exp(-0.1717\,Dn)\leqq R1\leqq 3.278\times 10^{15}\exp(-0.1456\,Dn);$$

and $$3.247\times10^{15}\exp(-0.1717\,Dn)\leqq R2\leqq 3.278\times 10^{15}\exp(-0.1456\,Dn).$$

2. The droplet ejection head as defined in claim 1, wherein:

the common supply channels are arranged in parallel, and are joined together at ends to constitute a supply manifold; and the common recovery channels are arranged in parallel, and are joined together at ends to constitute a recovery manifold.

3. The droplet ejection head as defined in claim 2, wherein the supply manifold and the recovery manifold are connected to each other through only the droplet ejection units.

4. The droplet ejection head as defined in claim 1, wherein in each of the droplet ejection units, the flow channel resistance R1 of the one of the individual supply channels is substantially equal to the flow channel resistance R2 of the one of the individual recovery channels.

5. The droplet ejection head as defined in claim 4, wherein in each of the droplet ejection units, a cross-sectional area and a length of the one of the individual supply channels are substantially equal respectively to a cross-sectional area and a length of the one of the individual recovery channels.

6. The droplet ejection head as defined in claim 5, wherein in each of the droplet ejection units, an arrangement of the one of the pressure chambers, the one of the individual supply channels and the one of the individual recovery channels is mirror symmetrical about a central axis of the one of the nozzles.

7. The droplet ejection head as defined in claim 5, wherein in each of the droplet ejection units, an arrangement of the one of the pressure chambers, the one of the individual supply channels and the one of the individual recovery channels is rotationally symmetrical about a central axis of the one of the nozzles.

8. The droplet ejection head as defined in claim 1, wherein in each of the droplet ejection units, the diameter Dn (μm) of the one of the nozzles, a flow channel inertance M1 ($kg/m^4$) of the one of the individual supply channels and a flow channel inertance M2 ($kg/m^4$) of the one of the individual recovery channels satisfy:

$$2.075\times10^{9}\exp(-8.369\times10^{-2}\,Dn)\leqq M1\leqq 1.838\times 10^{9}\exp(-6.475\times10^{-2}\,Dn);$$

and $$2.075\times10^{9}\exp(-8.369\times10^{-2}\,Dn)\leqq M2\leqq 1.838\times 10^{9}\exp(-6.475\times10^{-2}\,Dn).$$

9. The droplet ejection head as defined in claim 8, wherein in each of the droplet ejection units, the flow channel inertance M1 of the one of the individual supply channels is substantially equal to the flow channel inertance M2 of the one of the individual recovery channels.

10. The droplet ejection head as defined in claim 1, wherein each of the droplet ejection units includes a connecting channel which connects the one of the pressure chambers with the one of the nozzles.

* * * * *